United States Patent [19]

Blondeau

[11] Patent Number: 4,615,559

[45] Date of Patent: Oct. 7, 1986

[54] FOLDING TABLE/BENCH COMBINATION

[76] Inventor: Roland A. Blondeau, 6611 SW. 36th Ave., Portland, Oreg. 97221

[21] Appl. No.: 715,274

[22] Filed: Mar. 25, 1985

[51] Int. Cl.[4] ..... A47B 85/04

[52] U.S. Cl. ..... 297/124; 297/54; 297/169

[58] Field of Search ..... 297/124, 171, 159, 174, 297/47, 52, 31, 169

[56] References Cited

U.S. PATENT DOCUMENTS

| | | | |
|---|---|---|---|
| 1,173,480 | 2/1916 | Bulik | 297/54 X |
| 1,896,455 | 2/1933 | McCulloh | 297/31 X |
| 2,421,127 | 5/1947 | Deckham | 297/159 X |
| 2,486,468 | 11/1949 | Freedman | 297/124 X |
| 2,530,785 | 11/1950 | Rocca | 297/124 X |
| 2,561,703 | 7/1951 | Koenig | 297/124 X |
| 2,587,176 | 2/1952 | Larson | 297/31 |

*Primary Examiner*—Francis K. Zugel
*Attorney, Agent, or Firm*—Glen A. Collett

[57] ABSTRACT

A folding bench/table combination including two spaced apart leg assemblies, each including a horizontal, forwardly extending seat support member, a seat leg pivoted to the rear end of the seat support member, a table leg pivoted midway along its length to the front end of the seat support member, a table support member pivoted to the top of the table leg, and an adjuster pivoted to the table support member and extending to the pivot point of the seat support member and the table leg, and being operable to be secured in a plurality of positions to orient the table top as a table, or as the back of a bench, or in conjunction with the entire assembly being operable to be folded flat for compact stacking and storage.

3 Claims, 7 Drawing Figures

FOLDING TABLE/BENCH COMBINATION

BACKGROUND OF THE INVENTION

This invention relates to articles of furniture, and more particularly to an improved furniture item suitable for use as a bench or a table.

Various attempts have been made in the past to provide a convertible bench and table, particularly of the styles commonly referred to as a "picnic table" and a "park bench", wherein a seat is provided, and, above that, a panel which is movable from a flat position in which it provides a table, to an inclined position in which the same panel provides the back of a bench. However, all designs heretofore, as far as it is known, include a multitude of parts which must be assembled and disassembled, or they are otherwise cumbersome to operate, or they are top-heavy, poorly-centered and have poor balance, or they have insufficient bracing and stops to prevent collapse under heavy loading, or they are not capable of efficient and compact folding for stacking and space saving storage capability.

Accordingly, it is the general object of the present invention to provide a much improved design of a folding bench/table combination piece of furniture.

A primary object is to provide such a piece of furniture which may be folded flat, very compactly, for storage.

Another object is to provide for very quick and simple unfolding, with no loose or separate pieces to get lost, or any need for the use of tools.

Yet another object is to provide an article of furniture which is easily adjusted to the configuration of a "park bench".

A further object is to provide an article of furniture which may be easily adjusted to the configuration of a "picnic table".

A still further object is to provide such an article of furniture which at all times is very stable and very secure under heavy loading.

Yet another object is to provide a very fashionable appearing article of furniture.

Another object is to provide for various lengths of such assemblies, making use of a standard leg assembly configuration, with a table top and seat of a length the user desires.

A further object is to be able to face two such articles together, in the table configuration, so that they form a standard double-wide, double-seat, picnic table in appearance, but remain functionally separate and independently stable.

These and other objects and the manner in which they are achieved will be made apparent as the specification and claims proceed, taken in conjunction with the drawings, which illustrate the preferred embodiment.

SUMMARY OF THE INVENTION

A folding bench/table combination including two spaced apart leg assemblies, each including a horizontal, forwardly extending seat support member, a seat leg pivoted to the rear end of the seat support member, a table leg pivoted midway along its length to the front end of the seat support member, and a table support member pivoted to the top of the table leg, and further including a seat extending between the leg assemblies, and a table top extending between the table support members, the table being convertible to such a configuration that it forms the back of a bench, and that it, in conjunction with the entire assembly may be folded flat for compact stacking and/or storage.

DESCRIPTION OF THE PREFERRED EMBODIMENTS

Figure 1:
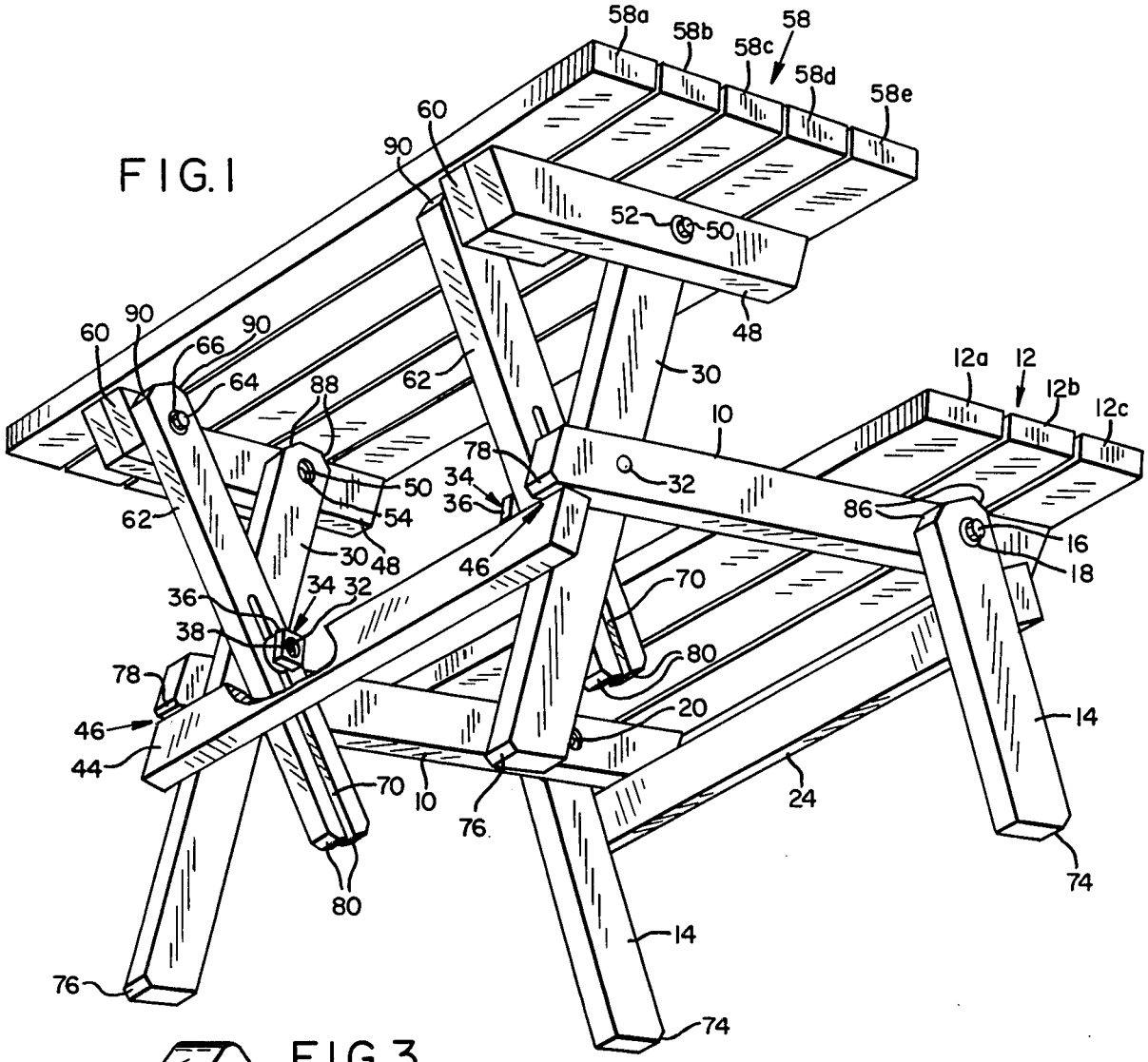
FIG. 1 is a bottom perspective view of the folding table/bench combination of the present invention, shown in table configuration, a small portion of the table leg cross brace being broken away to show more clearly the mechanism.

FIG. 1 illustrates that the preferred embodiment of the folding table/bench of the present invention includes a seat support member 10 which is positioned at a suitable height by the legs for supporting a seat, shown generally at 12. The seat support member extends substantially horizontally, forwardly of the seat in order to tie together and mount the remainder of the assembly.

Figure 4:
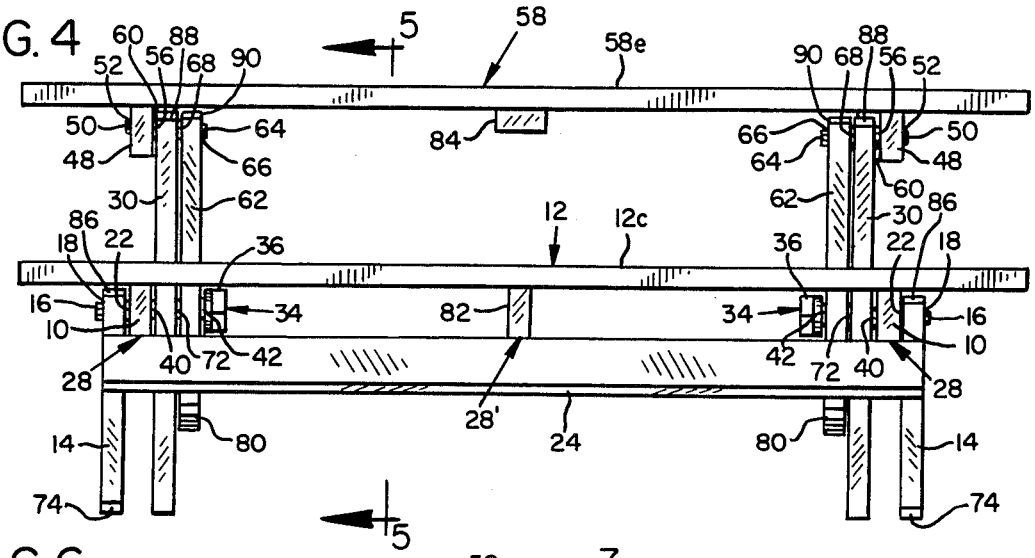
FIG. 4 is a front (seat on the near side) plan view of the second embodiment of the present invention, being slightly longer than the version shown in FIG. 1.
Figure 6:
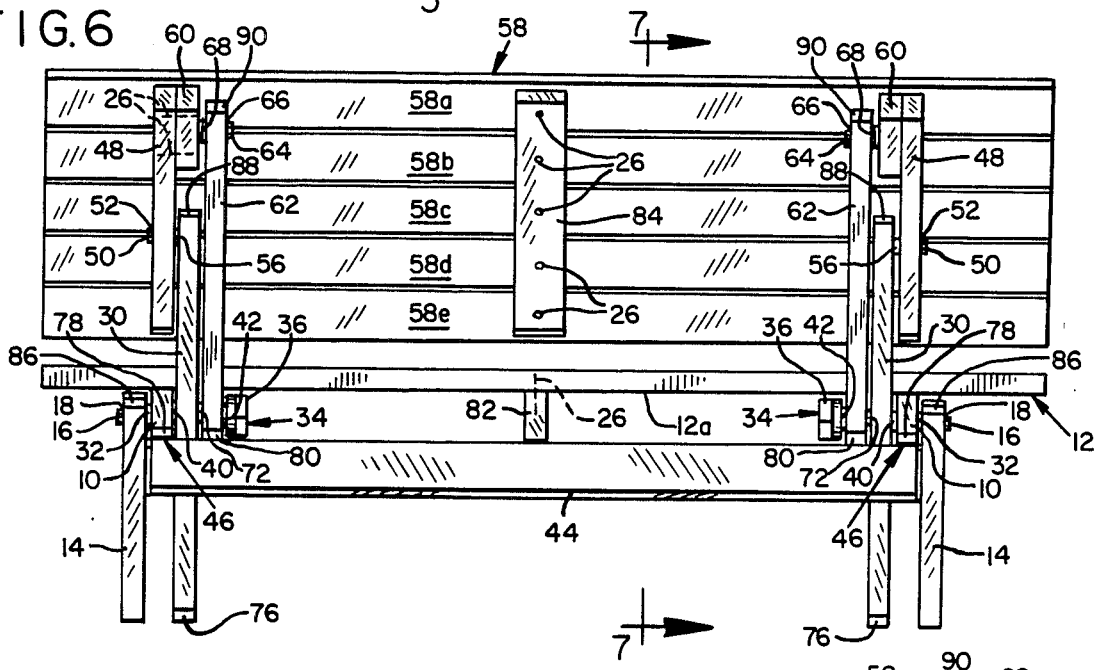
FIG. 6 is a back (seat on the far side) plan view of the article of furniture of FIG. 4, converted to its bench configuration.

Seat 12 may be constructed in any manner desired, but to give the present article of furniture the appearance of a "picnic table", seat 12 comprises three longitudinal stringers **12*a*, 12*b*, and 12*c*. The seat interconnects two similar leg assemblies, resting at each end on seat support member 10. Of course the seat may be of any reasonable length desired; the proportions shown in FIG. 1 are that of an adult sized table about four feet long. Longer units are shown in FIGS. 4 and 6**.

Below the seat is located seat leg 14 which is pivoted to seat support member 10 proximate the rear end thereof. A bolt 16 pivots the seat leg, faced by a washer 18 and threaded into a T-nut 20 in the seat support member. A washer 22 is located between the seat leg and the seat support member (FIG. 4). The top of the leg is chamfered at 86 to allow pivoting of the leg. The bottom of the leg is chamfered at 74 for safety and to prevent splitting. The seat leg is operable to pivot between a first position wherein it is parallel with the seat support member (FIG. 2), to a second position where it extends downwardly and rearwardly beneath the seat for supporting the seat and weight thereon. Note that the angle of the seat leg is approximately 17°, as are all the design, primarily for safety and stability, and the proper positioning of the table as explained hereinafter, but also for appearance sake and ease of manufacture. The seat legs are positioned on the outside of the seat support member on both ends, so one leg assembly is the mirror image of the other.

Figure 5:
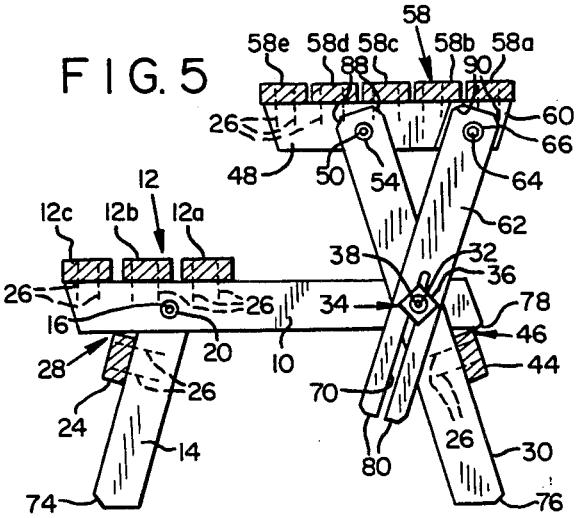
FIG. 5 is a section taken along the line 5—5 of FIG. 4, illustrating the article in its table configuration.

Seat legs 14 are interconnected by seat leg cross brace 24. Thus both seat legs function as a unit. As shown as an example in FIGS. 5 and 6, the seat stringers **12*a–c* are connected to the seat support member 10, and the seat leg cross brace is connected to the seat legs by fasteners denoted at 26. These fasteners may be nails, screws, dowells, adhesive, or any other useable fastener desired. This likewise applies throughout the unit. The seat leg cross brace abuts the seat support member at a stop point denoted at 28. This provides surety that once leg 14** is extended below the seat and bearing weight, it is solid and safe. Because of the angles, there may be some wearing at the stop point after extended use, but this is to be expected and does not affect the function of the apparatus.

Figure 3:
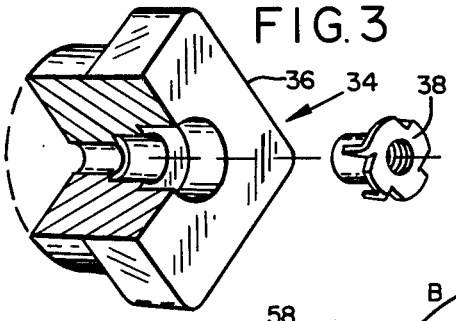
FIG. 3 is a broken away perspective view of the handnut used in the present invention.
Figure 2:
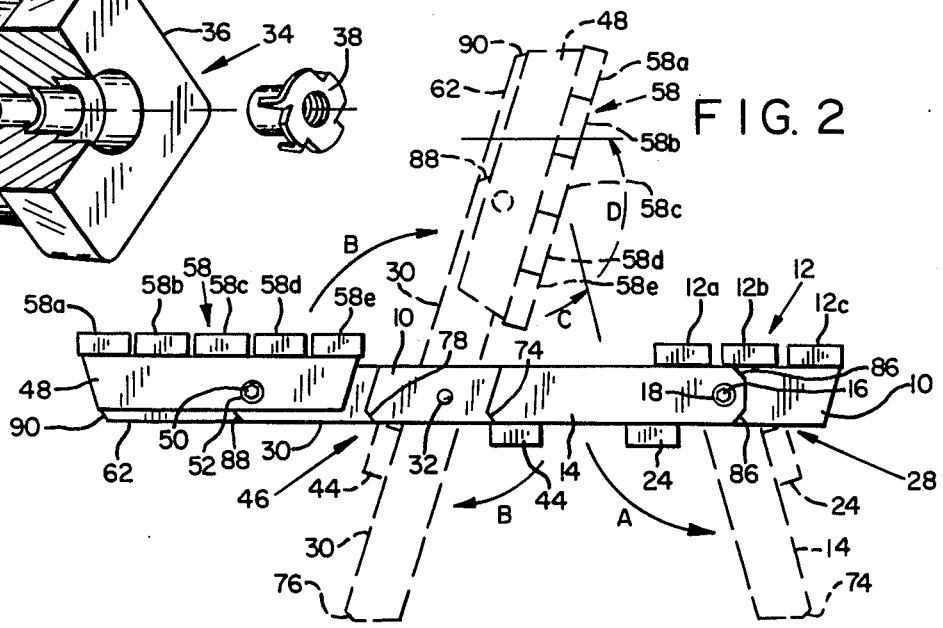
FIG. 2 is a side view of the invention illustrated in solid line in its completely collapsed condition, the dashed line illustrating the set-up sequence.

Of each leg assembly, a table leg 30 is pivoted to the seat support member 10 proximate the front end thereof. Note that the table legs are on the inside of the seat support members, so that they will fold properly to be parallel with the seat support members as shown in FIG. 2, while not interfering with the seat legs 14. Each table leg is pivoted by a carriage bolt 32, which extends through the seat support member, the table leg, an adjuster 62 explained hereinafter, and into a handnut shown generally at 34. The handnut comprises a block 36 of a size easy to grasp and turn by hand, the block having a hole therein for receiving a T-nut 38 as detailed in FIG. 3. Table leg 30 is pivoted midway along its length, and is operable to pivot between a first position wherein it is parallel with the seat support member (FIG. 2), to a second position wherein the lower part of the leg extends downwardly and forwardly, and the upper part of the leg extends oppositely upwardly from the pivot point to a height suitable for mounting a table surface. Washer 40 is provided between the seat support member and the table leg, as is washer 42 adjacent the handnut.

Table legs 30 are interconnected by a cross brace 44, so that both table legs and all parts interconnected therewith function as a unit. Moreover, the table leg cross brace 44 provides stop points 46 which abut seat support member 10 at the front end thereof to determine the folded and unfolded positions of the table leg. This is similar to the seat leg cross brace 24, but note that the differences in length allow the overlapping folding in the folded position of FIG. 2.

The table leg is chamfered at its top at 88, in order to be able to pivot beneath the table, forming a somewhat rounded end. It is also chamfered at its foot at 76, for safety and to prevent splitting. Note that the table leg does not extend beyond the forward edge of the table, whereby two such tables may be abutted together forwardly, but still supports all of the weight of the table, making it very stable.

A table support member 48 is pivoted to the top of table leg 30 by a bolt 50, washer 52 and T-nut 54. A washer 56 is between the table leg and the table support member, as shown in FIGS. 4 and 6. The table support member mounts a table top, denoted generally at 58. The table top may be of varied size, and of any desired type of surface, but to provide the "picnic table" appearance, the table top is illustrated as composed of elongated table stringers 58*a*, 58*b*, 58*c*, 58*d* and 58*e*. Note that the table top overlaps the leg assemblies somewhat on its ends, as is common picnic table construction. Preferably, the length of the table top is the same as the length of the seat, although this is not a requirement of the construction.

Figure 7:
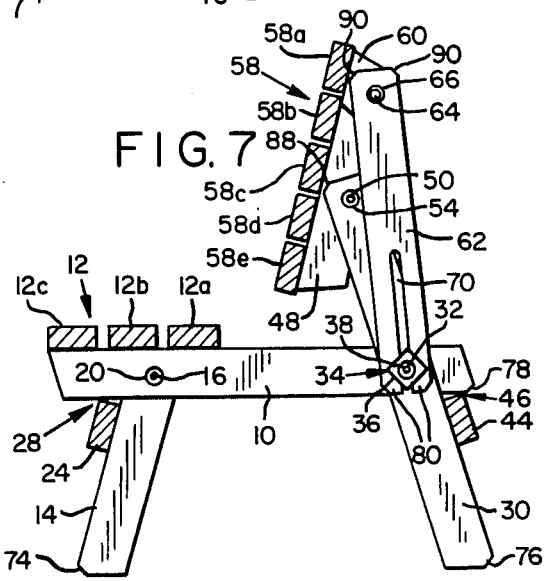
FIG. 7 is a section taken along the line 7—7 of FIG. 6.

A spacer 60 is affixed to the forward end of the table support member 48, and an adjuster 62 is pivoted thereto. This, of course, is at a point spaced from the pivot of the table leg 30 with the table support member 48. A lag bolt 64 and a washer 66 provide the pivot. Washer/spacers 68, between the adjuster and spacer 60 set the adjuster apart the appropriate distance from the table support member. The adjuster extends to the pivot point of the seat support member 10 and the table leg 30, and there are means provided for securing the adjuster at any point along its length, which thus secures the table 58 in any of a plurality of positions. Preferably, adjuster 62 has a slot 70 therein which overlaps bolt 32 and is tightened by handnut 34. The slot provides an infinite range of adjustment, from parallel with the table leg, as shown in FIG. 2, through the bench positions of FIGS. 6 and 7, and to the table position of FIGS. 1, 4 and 5, and slightly over-horizontal to accommodate placement on uneven ground or the like. Of course, any intermediate position is possible as desired by the user. Adjuster 62 is chamfered at its top at 90 to round it for pivoting, and at its bottom at 80 for the purpose of safety. A washer 72 is located on bolt 32 between the adjuster and the table leg.

It can be seen that the present bench/table combination may be made entirely from 2 by 4 inch dimension lumber, although any other appropriate material may instead be employed. To conserve material and facilitate construction, all cuts are made at the selected 17° angle. In order to prevent splitting and to promote safety, the ends of the boards forming seat support member 10, seat leg 14, table leg 30 and adjuster 62 are chamfered wherever there is a sharp end, at 78, 74, 76 and 80 respectively.

The second embodiment of the folding table/bench combination of the present invention is shown particularly in FIGS. 4 and 6. It is merely an elongated version of the unit shown in FIG. 1. In addition, however, is a central seat brace 82 which solidifies and supports seat 12. Note that in the unfolded condition, seat brace 82 bears against seat leg cross brace at stop point 28'. Likewise provided is a table brace 84 which solidifies table top 58. The table brace is turned flat so as to not provide an obstruction on the underside of the table. More than one seat brace and table brace could be employed, depending on the length of the assembly, as needed.

Thus, there is provided a leg assembly at each end of the bench/table combination, including seat support member 10, seat leg 14, table leg 30, table support member 48, spacer 60, adjuster 62, and the appropriate connecting hardware. Longitudinal members, which may be of any length desired, include seat stringers 12*a*–12*c*, table stringers 58*a*–58*e*, seat leg cross brace 24 and table leg cross brace 44.

It is possible to insert a third, or additional leg assembly midway in the length of the longitudinal members if desired. This is accomplished by attaching table leg cross brace 44 to a slightly lengthened seat support member 10, instead of to table leg 30. (This assembly is not shown.) With such an arrangement, as many leg assemblies as needed could be used on and elongated table/bench.

FIG. 2 illustrates the manner of operation of the present invention. At the dimension illustrated, the flat folded assembly is four feet long, approximately four feet deep, and only $6\frac{3}{4}$ inches in thickness. It is unfolded by first pivoting the seat leg assembly in the direction of arrow A. Then the table leg assembly is pivoted in the direction of arrows B. The handnuts 34 being loosened, the table top assembly may then pivot, first to the position of a bench as in FIGS. 6 and 7, by moving to the position illustrated by the arrow C and tightening the handnuts, or swinging it on to the table position of FIGS. 1,4 and 5, through the arc illustrated by the arrow D, and then tightening the handnuts.

It can be seen that a very stable and efficient bench/table combination has been provided by the present invention, satisfying the objects set forth. Obvious modifications may be made to the structure without departing from the intended spirit and scope of the invention.

Having described my invention in its preferred embodiments, I claim:

1. A folding bench/table combination comprising:

(a) two leg assemblies spaced apart in similar and square orientation, and each including:

(1) a seat support member at a suitable height for supporting a seat, and extending substantially horizontally, forwardly therefrom, (2) a seat leg pivoted to one side of the seat support member proximate the rear end thereof beneath the seat, and being operable to pivot between a first position wherein it is parallel with the seat support member, to a second position wherein it extends downwardly and rearwardly beneath the seat for supporting the seat and weight thereon, (3) a table leg pivoted to the opposite side of the seat support member from the seat leg, proximate the front end of the seat support member, and being operable to pivot between a first position wherein it is parallel with the seat support member, to a second position wherein the lower part of the leg extends downwardly and forwardly, and the upper part of the leg extends upwardly from the pivot point to a height suitable for a table surface, and (4) a table support member pivoted to the table leg proximate the top end thereof, and operable to pivot between a first position wherein it is parallel with the table leg, and a second position wherein it is horizontal for supporting a table;

(5) said leg assemblies each further comprising an adjuster pivoted to the table support member at a point spaced from the pivot of the table leg with the table support member, the adjuster extending to the pivot point of the seat support member and the table leg and having means at said pivot point for securing the adjuster at any of a plurality of positions along its length to said table leg and said seat support member, thus securing the table in any of a plurality of positions, (b) a seat spanning between the two seat support members; and (c) a table spanning between the two table support members, (d) said bench/table combination further comprising a seat leg cross brace secured between the seat legs on the rear sides thereof, and having an abutment surface which abuts the underside of the seat support member and acts as a stop to prevent the seat legs from pivoting further rearwardly, and a table leg cross brace secured between the table legs on the front sides thereof and below the pivot point, and having an abutment surface which abuts the underside of the seat support member and acts as a stop to prevent the table legs from pivoting further forwardly, one of said cross braces having an abutment surface extending outwardly beyond the legs.

2. The apparatus of claim 1 wherein the seat legs are mounted on the outsides of the seat support members and the table legs are mounted on the insides of the seat support members.

3. The apparatus of claim 1 further comprising a bolt and hand-operated nut associated therewith engaging the seat support member, the table leg and the adjuster at the pivot point for releasably securing both the pivoting movement of the table leg, and the position of the adjuster, so setting the table angle.

* * * * *